US007368699B2

(12) United States Patent
Shamir et al.

(10) Patent No.: US 7,368,699 B2
(45) Date of Patent: May 6, 2008

(54) SEGMENTED IMAGE INTENSIFIER

(75) Inventors: Hanan Shamir, Haifa (IL); Joseph Yaeli, Haifa (IL); Yoav Ophir, Zichron Yaacov (IL)

(73) Assignee: Elbit Systems Ltd. c/o Elop Electrooptics Industries Ltd., Rehovot (IL)

( * ) Notice: Subject to any disclaimer, the term of this patent is extended or adjusted under 35 U.S.C. 154(b) by 211 days.

(21) Appl. No.: 10/473,360

(22) PCT Filed: Apr. 8, 2002

(86) PCT No.: PCT/IL02/00287

§ 371 (c)(1),
(2), (4) Date: Sep. 30, 2003

(87) PCT Pub. No.: WO02/082494

PCT Pub. Date: Oct. 17, 2002

(65) Prior Publication Data

US 2004/0099793 A1 May 27, 2004

(30) Foreign Application Priority Data

Apr. 10, 2001 (IL) ..... 142517

(51) Int. Cl.
*H01J 43/04* (2006.01)

(52) U.S. Cl. ..... 250/214 VT; 250/207; 313/105 CM

(58) Field of Classification Search ..... 250/214 VT, 250/207, 208.1; 313/105
See application file for complete search history.

(56) References Cited

U.S. PATENT DOCUMENTS

| | | | | |
|---|---|---|---|---|
| 4,024,391 | A | 5/1977 | Bosserman et al. | |
| 4,990,766 | A | 2/1991 | Simms et al. | |
| 5,471,051 | A * | 11/1995 | Niigaki | 250/214 VT |
| 5,675,160 | A * | 10/1997 | Oikawa | 257/296 |
| 6,222,675 | B1 * | 4/2001 | Mall et al. | 359/630 |
| 6,501,504 | B1 * | 12/2002 | Tatko et al. | 348/229.1 |

FOREIGN PATENT DOCUMENTS

| | | |
|---|---|---|
| DE | 3527167 | 2/1987 |
| GB | 822166 | 10/1959 |
| JP | 61007553 | 1/1986 |
| WO | WO 99-50874 | 10/1999 |

OTHER PUBLICATIONS

Office Action issued by the European Patent and Trademark Office for Application No. 02 724 585 1 dated Sep. 29, 2006.

* cited by examiner

*Primary Examiner*—Thanh X. Luu
*Assistant Examiner*—Tony Ko
(74) *Attorney, Agent, or Firm*—Pearl Cohen Zedek Latzer, LLP

(57) ABSTRACT

According to some embodiments of the invention, an image intensifier is provided. The image intensifier comprises a layer of electrically isolated electrode segments each able to receive an electrical potential independently of the other electrode segments. The electrode segments may be coated onto an inner surface of an entrance window and each of the electrode segments is coated with a photocathode segment. Alternatively, the electrode segments are positioned between a photocathode layer and a micro channel plate.

37 Claims, 14 Drawing Sheets

SEGMENTED IMAGE INTENSIFIER

CROSS-REFERENCE TO RELATED APPLICATIONS

This application is a National Phase Application of PCT International Application No. PCT/IL02/00287, International Filing Date Apr. 8, 2002, claiming priority of Israeli Patent Application No. 142517, filed Apr. 10, 2001.

BACKGROUND OF THE INVENTION

Many night vision systems use image intensifiers as optical amplifiers. The image intensifier may generally comprise a photocathode to convert input photons into electrons, a microchannel plate (MCP) to multiply the electrons and a phosphor screen to convert the electrons back to photons, thus displaying an intensified image. The photoelectrons accelerate under the influence of an applied electrical field from a power supply and reach the MCP. An electrical field is also applied to the MCP where a secondary electron emission occurs which may multiple the number of electrons by several orders of magnitude.

When using a conventional image intensifier, the image is intensified as a whole, namely all the pixels are intensified by the same amount. The amount of the amplification is related to the number of electrons that pass to the MCP and may be controlled by changing the potential gradient across the device. In conventional image intensifiers, however, it may not be possible to control selectively only certain electrons that are associated with a specific segment of an input image. Consequently, in some environmental conditions, the quality of the intensified image may be poor. For example, an intense source of light, such as, for example, a street lamp, that passes into the field of view may mask the image of a darker area in its vicinity.

Furthermore, conventional image intensifiers may not enable certain desirable applications, such as, for example, to plant an external image on part of the field of view of an intensified image without loss of high quality performance. This exemplary application is particularly useful in devices, such as, night vision goggles (NVG), typically used by pilots.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
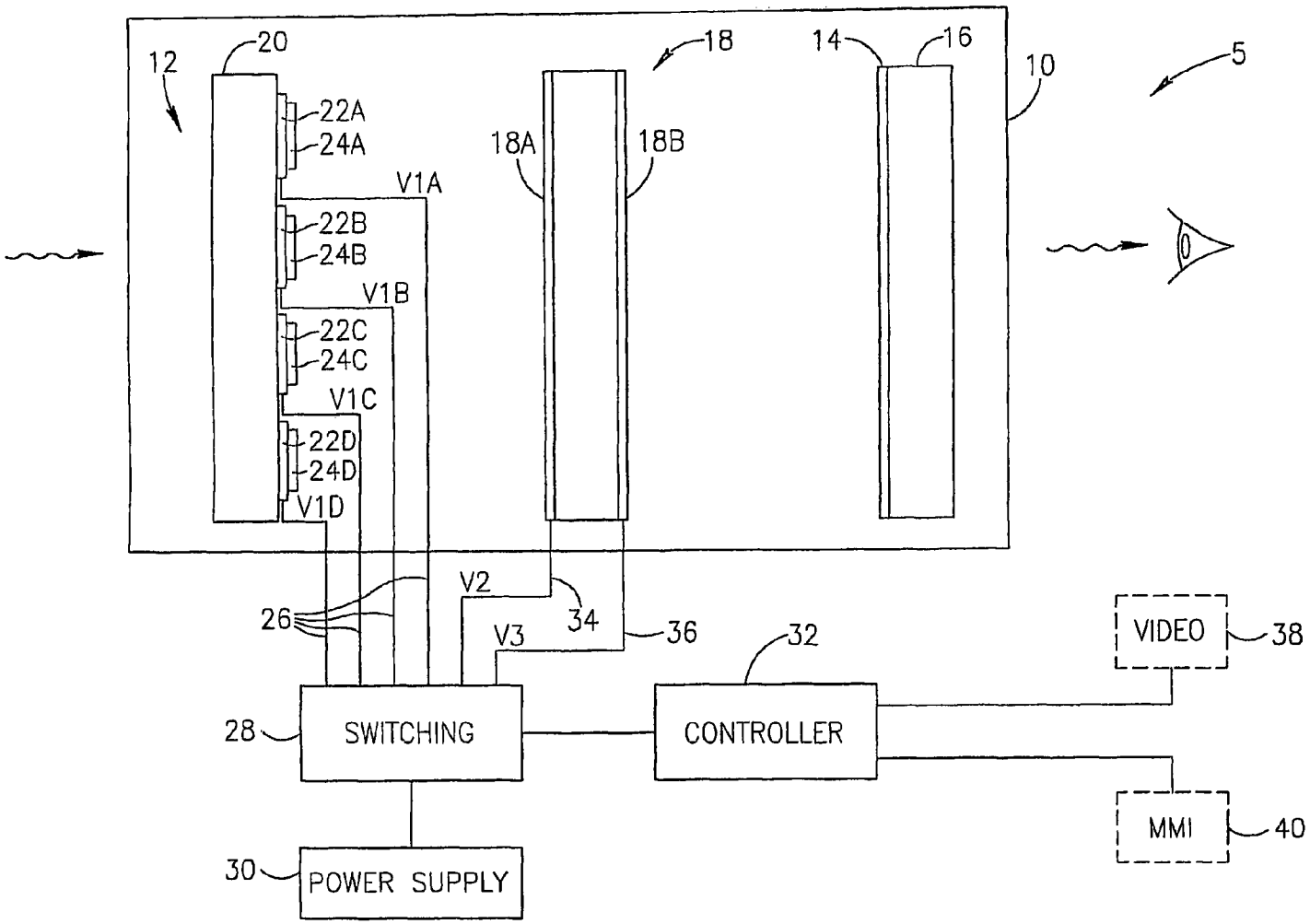
FIG. 1 is a schematic illustration of an observation system having an image intensifier according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, components and circuits have not been described in detail so as not to obscure the present invention. While some embodiments of the present invention will be described, for purposes of illustration only, in conjunction with a single micro channel plate (MCP) structure, the present method and system for segmental image control is applicable also to other image intensifier structures.

Some embodiments of the present invention are directed to a method and corresponding system for segmental control of incoming low-light images via usage of at least one image intensifier having a segmented electrode layer, which is split to provide two or more electrically isolated electrode segments. The system may provide independent electrical potential to the segments. In some embodiments of the present invention the independent electrical potential may be provided to the segments generally simultaneously. The system may comprise a logical unit, which may determine whether, when and how much to intensify a particular image segment in order to receive an improved intensified image. Alternatively or additionally an operator may manually determine such.

When an image is projected onto the image intensifier, each electrode segment is associated with a corresponding segment of the image. Since the system may enable the application of an independent electrical potential to each electrode segment, which controls independently the electron flow for each segment, segmental control of the intensified image may be enabled.

Various embodiments of the present invention will now be described. In some embodiments, which will be described hereinbelow with respect to FIGS. 1 and 2, the segmented electrode layer is a driving electrode layer situated between the entrance window and the photocathode. In these embodiments, the photocathode layer is also segmented. In other embodiments, which will be described hereinbelow with respect to FIGS. 3 and 4, the segmented electrode layer is attached to the surface of the photocathode that faces the MCP. It will be appreciated by persons skilled in the art that embodiments of the invention are equally applicable to other configurations, such as for example, the segmented electrode being the entrance MCP electrode or the exit MCP electrode.

In further embodiments, which will be described hereinbelow with respect to FIG. 5, the device may comprise a thin filmed transistor (TFT) node mechanism. These embodiments may enable to maintain the ability to apply substantially simultaneously an independent electrical potential to each electrode segment when the number of segments is increased without over-increasing the number of conducive leads connecting between a segment and the power supply. Also described herein with respect to FIGS. 6-13 are non-limiting examples of applications of the device and method.

Reference is now made to FIG. 1, which is a schematic illustration of an observation system having a segmented image intensifier according to some embodiments of the present invention. System 5 may comprise an image intensifier 10. Image intensifier 10 may comprise an input assembly 12 at one end of device 10 and a phosphor screen 14 attached to an output window 16 at the other end. It should be understood by person s skilled in the art that other output combinations may be used, such as, for example, a phosphor coated fiber optic tayper, which may be coupled to an imaging sensor, such as, for example, a CCD or a CMOS imager. Image intensifier 10 may further comprise at least one micro channel plate 18 positioned between input assembly 12 and phosphor screen 14. Micro channel plate may comprise an entrance electrode 18A and an exit electrode 18B.

Figure 2:
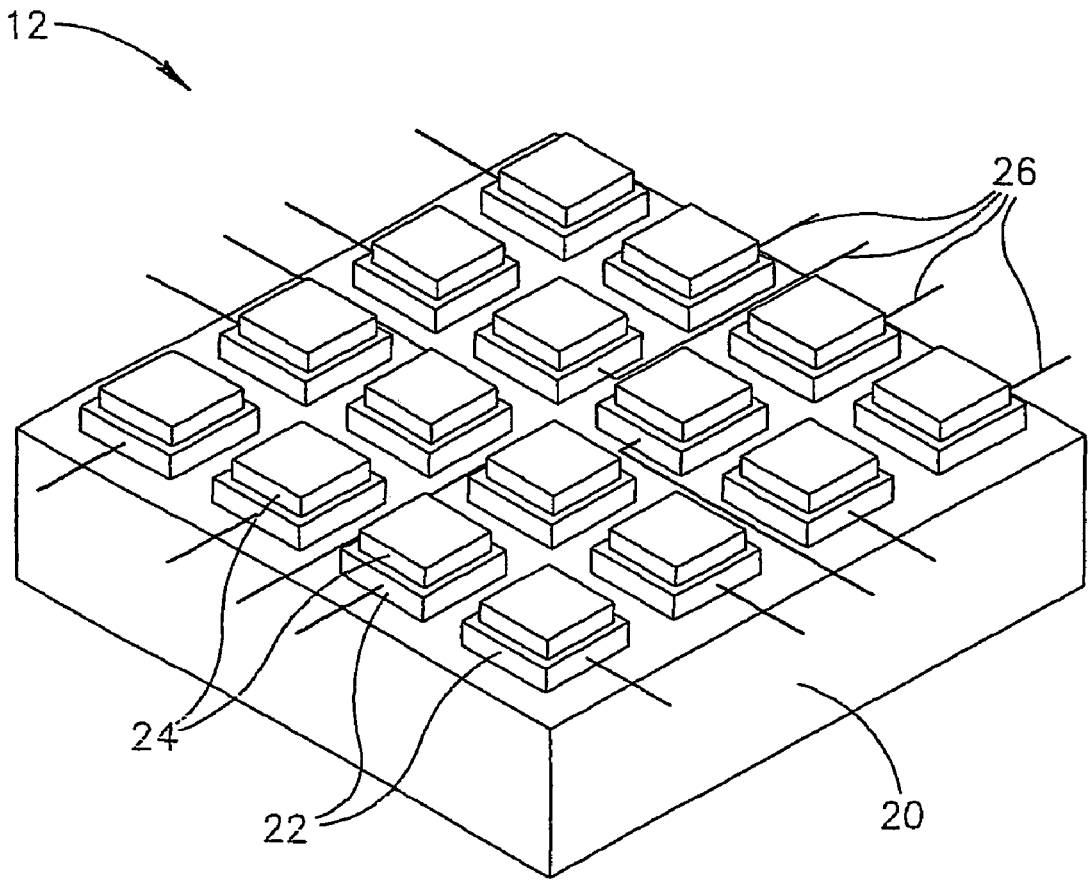
FIG. 2 is a perspective view of the input assembly of the image intensifier of FIG. 1.

Reference is additionally made to FIG. 2, which show a simplified perspective view of the photocathode-electrode input-assembly according to some embodiments of the present invention. Input assembly 12 may comprise a transparent input window 20 and a layer of electrode segments 22 coated on window 20. Window 20 may be made of a transparent material, such as, for example, glass tailored for the application spectrum range. Window 20 may be flat, curved or of any suitable arbitrary shape. Each electrode segment may be coated with a photocathode segment 24. Each electrode segment 22 may be electrically isolated from the other segments. The layer of the electrode segments and the layer of the photocathode segments may be formed by various methods, such as, for example, photolithography or any other methods known in the art. In the exemplary illustration of FIG. 2, input window is coated with 16 independent electrodes arranged in a bi-axial array. However it should be understood to a person skilled in the art that the shape and number of the segments may vary and the segments position and shape may be pre-designed to match particular desirable applications.

System 5 may further comprise a switching unit 28 coupled to image intensifier 10, a power supply 30 and a controller unit 32, each coupled to switching unit 28. Each electrode 22 may be individually coupled via an independent connecting electrical lead 26 to switching unit 28. Electrical leads 26 that connect between an inner electrode segment 22 and switching unit 28 may be positioned on input window 20 in the exposed areas between segments to maintain the electrical isolation. Each electrode segment 22 may be able to receive from power supply 30 an electrical potential $V_1$ independent of the other electrode segments' potential. For example, segment 22A may receive a potential $V_{1A}$, which may be different from $V_{1B}$-$V_{1D}$ received by segments 22B-22D, respectively. According to some embodiments of the present invention, each electrode segment 22 may be able to receive from power supply 30 generally simultaneously an electrical potential $V_1$ independent of the other electrode segments' potential.

Each MCP entrance electrode 18A and MCP exit electrode 18B may be coupled via connecting leads 34 and 36, respectively to switching unit 28, which may include a gain controlling sub-unit Alternatively, leads 34 and 36 may be coupled to a separate controlling unit and power supply (not shown). In such a case, there is a ground reference between the two power supplies. Electrode 18A may be able to receive from power supply 30 an electrical potential $V_2$ and electrode 18B may be able to receive from power supply 30 an electrical potential $V_3$. For electrons to be accelerated toward the MCP entrance electrode 18A, a negative potential difference between the accelerating electrode 22 and the MCP entrance electrode 18A is required ($V_1-V_2<0$). Decreasing the potential difference decreases the number of electrons that may reach the MCP 18.

When the potential difference between the accelerating electrode 22 and the MCP entrance electrode 18A is positive ($V_1-V_2>0$) the electrons may be blocked. For a typical non-segmented operation, all electrode segments 22 may be driven by the same potential, for example, $V_1=-200$ volt, when $V_2=0$. When, for example, a segment of the intensified image associated with electrode 22C is to be shuttered off, a potential of $V_{1C}=+20$ volt may be applied to that electrode 22C.

Electrode segments 22 may be generally simultaneously driven by controller 32. Controller 32 may involve one or more modes of operations, such as a manual operation mode, an automatic operation mode, or any combination thereof.

In the manual operation mode, the user may function as a real-time sensor enabling a dynamic scene evaluation via a feedback mechanism. The user may define the segments to be controlled and may provide controlling instructions via man-machine interface (MMI) 40. The operator may watch the intensified image provided by the image intensifier. The operator may then evaluate the quality of the intensified image and if necessary activate the feedback mechanism via man-machine interface 40. Man-machine interface 40 may transfer the instructions to controller 32. Controller 32 may then perform logical algorithms if necessary and may generate corresponding analog instructions, which are sent to switching unit 28. Switching unit, which is connected independently to electrode segments of the image intensifier as described herein above may then deliver a desired voltage to the required electrode segments according to the control signals received from controller 32.

Controller 32 may comprise a logic module (not shown) having at least one algorithm, such as, for example, a module for generating signals that determine the gain for each segment and a module for generating a switching signal that determines the gating time for each segment.

In the automatic mode, electrodes 22 may serve as sensors measuring the current generated by the photoelectrons to enable the evaluation of the image for a feedback mechanism that may generate instructions regarding segmental operation using techniques known in the art. In these embodiments, switching unit 28 may also function as a current sensor that may measure the current for each electrode segment. The measurements may then be sent to controller 32 that may analyze them and may evaluate the quality of the intensified image. If necessary, controller 32 may then perform logical algorithms and may generate corresponding analog instructions, which are sent to switching unit 28.

Alternatively, a video camera 38 may be coupled to controller 32 and a video feedback for real-time segmental control using techniques known in the art may be performed. Video camera 38 may track the intensified image coming out of device 10 parallel to the eye of an operator using for example a beam splitter (not shown). Controller 32 may capture the input received at camera 38 and may evaluate the intensified image using a real-time image-processing module (not shown). For example, controller 32 may comprise an algorithm for monitoring and analyzing the image segments level for passing a threshold and evaluate best-fit signals to correct the image. The best-fit function may be constructed according to the steepest descent method or any other best-fit method. If necessary, controller 32 may generate a set of instructions for segmental operation, which are sent to switching unit 28 in order to improve the captured scene.

Figure 3:
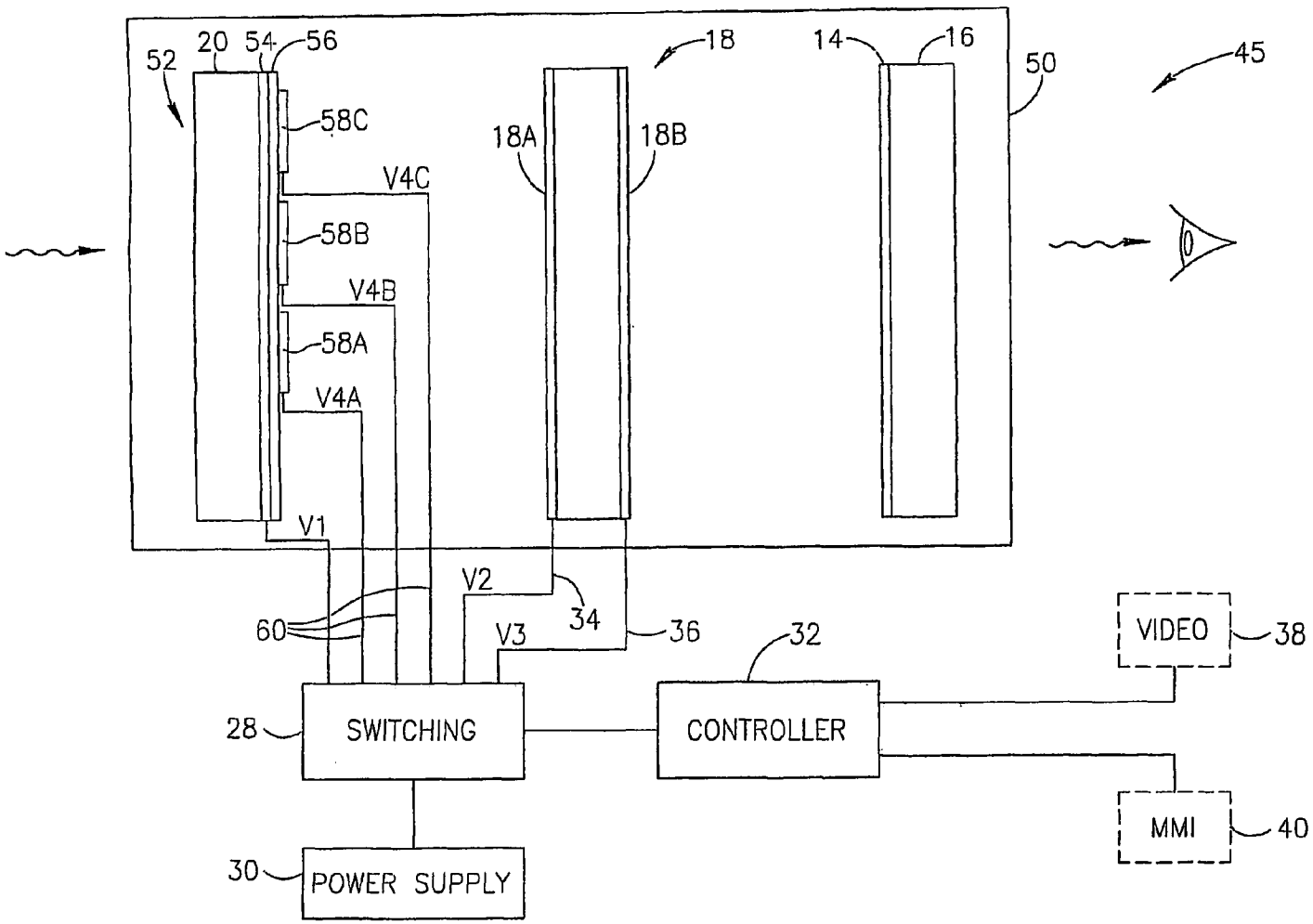
FIG. 3 is an illustration of an observation system having an image intensifier according to some embodiments of the present invention.
Figure 4:
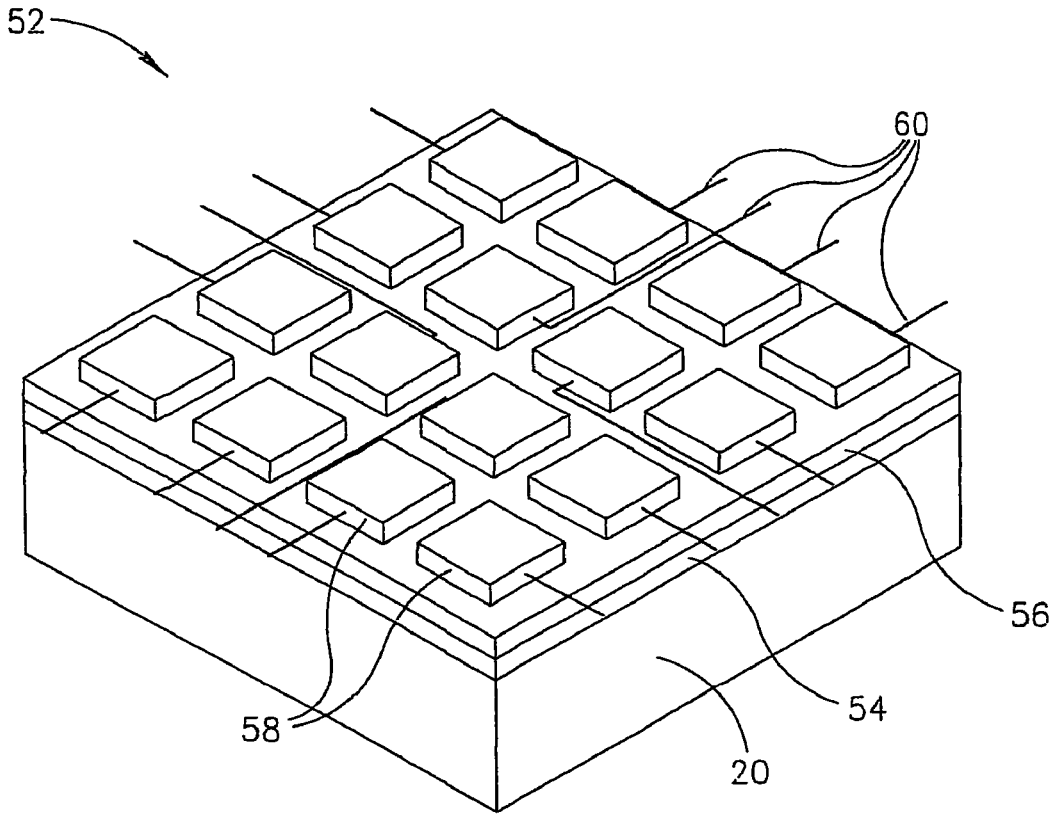
FIG. 4 is a perspective view of the input assembly of the image intensifier of FIG. 2.

Reference is now made to FIG. 3, which is a schematic illustration of an observation system having an image intensifier according to other embodiments of the present invention. Reference is additionally made to FIG. 4, which is simplified perspective view of the input assembly of the image intensifier of FIG. 3. A system 45 may comprise an image intensifier 50. Image intensifier 50 may comprise an input assembly 52, MCP 18 and phosphor screen 14.

Input assembly 52 may comprise transparent window 20, an accelerated electrode layer 54 coated on window 20 and a photocathode layer 56 coated onto electrode layer 54. Electrode layer 54 may be, for example, in the form of a fine-mesh grid. The ratio between the area taken by the wires and the entire area may be, for example, approximately 1:100. Input assembly 52 may further comprise one or more electrically isolated electrode segments 58 attached to photocathode layer 56 such that segments 58 are positioned between photocathode 56 and MCP 18.

Each electrode segment 58 may be, for example, in the form of a mesh having a period smaller that the size of the segment Each electrode segment 58 may be individually coupled via an independent connecting electrical lead 60 to switching unit 28. Each electrode segment 58 may be able to receive from power supply 30 an electrical potential $V_4$ independently of the other electrode segments. For example, segment 58A may receive a potential $V_{4A}$, which may be different from $V_{4B}$-$V_{4C}$ received by segments 58A-58C, respectively. According to some embodiments of the present invention, each electrode segment 58 may be able to receive from power supply 30 generally simultaneously an electrical potential $V_4$ independently of the other electrode segments.

For electrons to be accelerated toward the MCP entrance electrode 18A, the potential difference between the accelerating electrode 54 and the absorbing electrode segment 58 may be zero or negative ($V_4-V_1 \leqq 0$). When the potential difference between the accelerating electrode 54 and the absorbing electrode segment 58 is positive ($V_4-V_1 > 0$) the elections may be absorbed by electrode segment 58. As an example, electrode segments 58A and 58B may be applied with the same potential as accelerating electrode 54 ($V_4-V_1=0$), thus enabling the acceleration of electrons.

Simultaneously, electrode segment 58C may be applied with a positive potential relative to the potential of the accelerating electrode 54 ($V_4-V_1=+10$ volt), thus absorbing the electrons emitted from photocathode 56, which are in the vicinity of segment 58C and shutting off the respective image segment. Image intensifier 50 may be useful, for example, to control locally the gain of segments that markedly differ in their illumination from the average illumination of the scene. An example of such an environment is a bright section adjacent to a darker section, where it is desirable to amplify the darker section more than the bright section.

Figure 5:
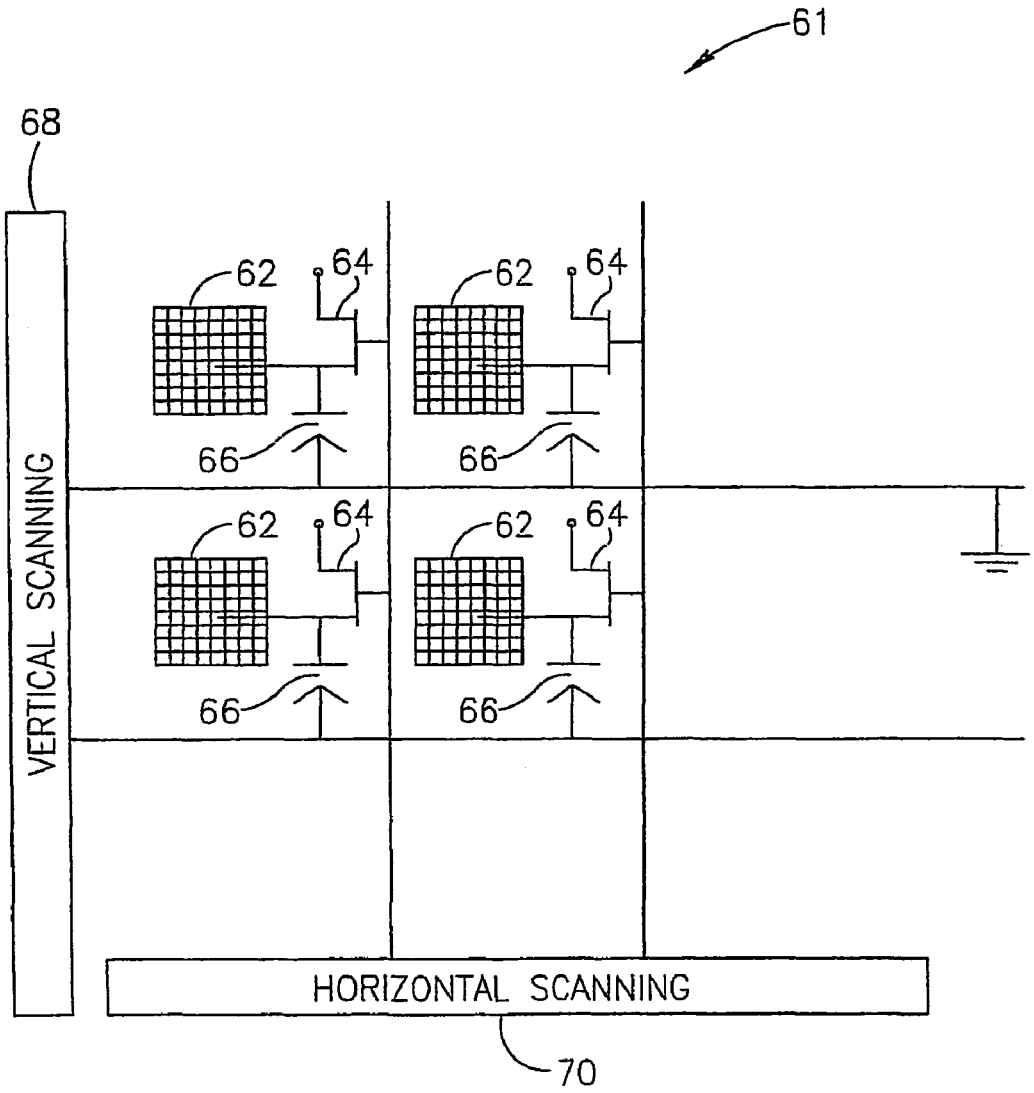
FIG. 5 is a schematic illustration of a portion of an image intensifier having a segmented electrode layer coupled to a memory-node structure according to some embodiments of the present invention.

Reference is now made to FIG. 5, which is a schematic illustration of a portion of an image intensifier having a layer of electrode segments coupled to a charge memory-node structure according to some embodiments of the present invention. A device 60 may comprise a layer of electrode segments 62. The layer of electrode segments may serve as an accelerating electrode positioned between the input window and the photocathode layer or as an absorbing electrode positioned onto the photocathode layer facing the MPC. Alternatively, electrodes segments may serve as an MPC entrance or exit electrode.

A thin filmed transistor (TFT) 64 and a charge capacitor 66 may be coupled to each electrode segment 62. This structure may provide the ability to increase the number of electrode segments while preserving the parallel mechanism of segmental control. Device 60 may further comprise a refreshing scanning mechanism to charge or discharge the node's charge-memory. A vertical scanning unit 68 and a horizontal scanning unit 70 may operate by opening and shutting each TFT gate 64, thus allowing or inhibiting current flow to the attached capacitor 66 using techniques known in the art. This structure may provide each electrode 62 with independent potential, while preserving the parallel functionality of the image intensifier.

The segmented image intensifier described hereinabove may be operated in various modes of operation according to a specific desirable application The number, position and shape of the electrode segments is determined during manufacture. Each electrode segment may be activated to intensify the incoming light independently. Each segment may be activated in a continuous range of light amplification. The segments may be operated substantially simultaneously in the time domain. In another mode of operation, the segments may be operated at different timing with fixed or variable delay.

The systems described above may be used for many applications of which some examples are described hereinbelow. The following examples are now given, though by way of illustration only, to show certain aspects of some embodiments of the present invention without limiting its scope.

EXAMPLE I

Blocking or Dimming a Portion of the Scene

Figure 6B:
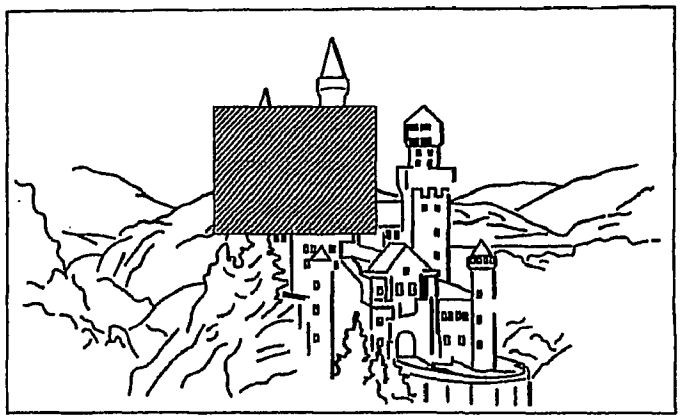
FIGS. 6A-6D are images that illustrate blocking a window inside an intensified image according to some embodiments of the present invention.
Figure 6D:
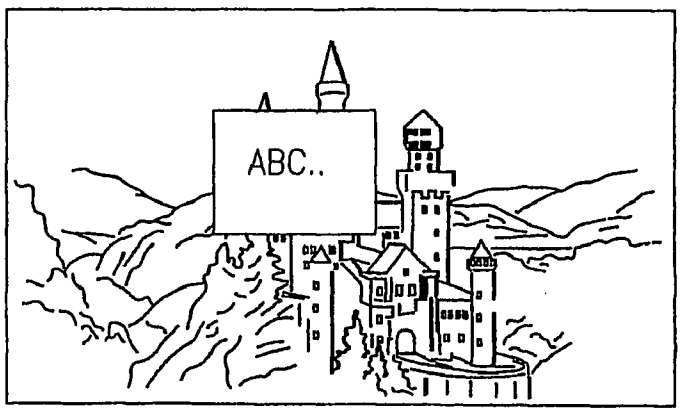
Figure 6A:
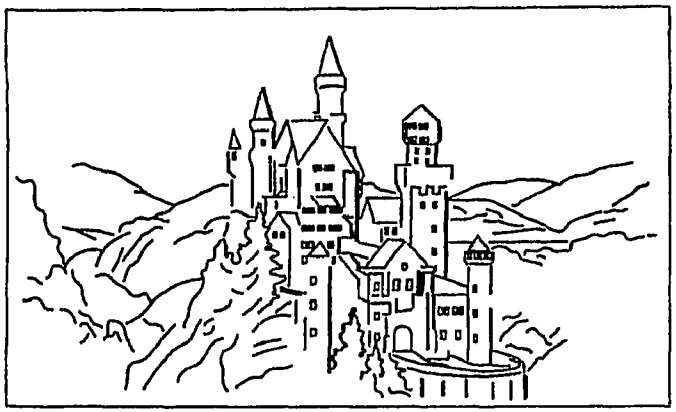
Figure 6C:
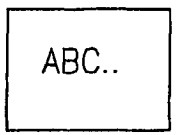

Reference is now made to FIGS. 6A-D, which are images that illustrate blocking a window inside an intensified image according to some embodiments of the present invention. It is frequently desirable to shut off or to dim manually a part of a scene of an intensified image (FIG. 6A). An example of such an application may be blocking a window inside an intensified image (FIG. 6B) using an image intensifier having two segments according to some embodiments of the present invention. In these embodiments, one of the segments may be a segmental window positioned to cover a desirable portion of the image and the second segment may cover the rest of the image.

This application is particularly useful in devices, such as, for example, night vision goggles (NVG), typically used by pilots. Such an application may be used, for example, when an external display image (FIG. 6C) is to be planted at a certain portion of the intensified image as a second layer. When the second layer image is planted at the blocked region, no mutual interference between the intensified image and the second layer image is present The combination of the two layers (FIG. 6D) may be accomplished by additional optical means, such as a beam combiner.

Alternatively, it may be desirable to dim a specific segment in order to superimpose, for example, symbols in a controlled background or an external image, such as, for example, a FLIR image with a coaxial match filed of view in order to perform a fused enhanced image. If the region is not completely blocked but rather less intensified than the rest of the image, then interference is reduced.

Figure 7:
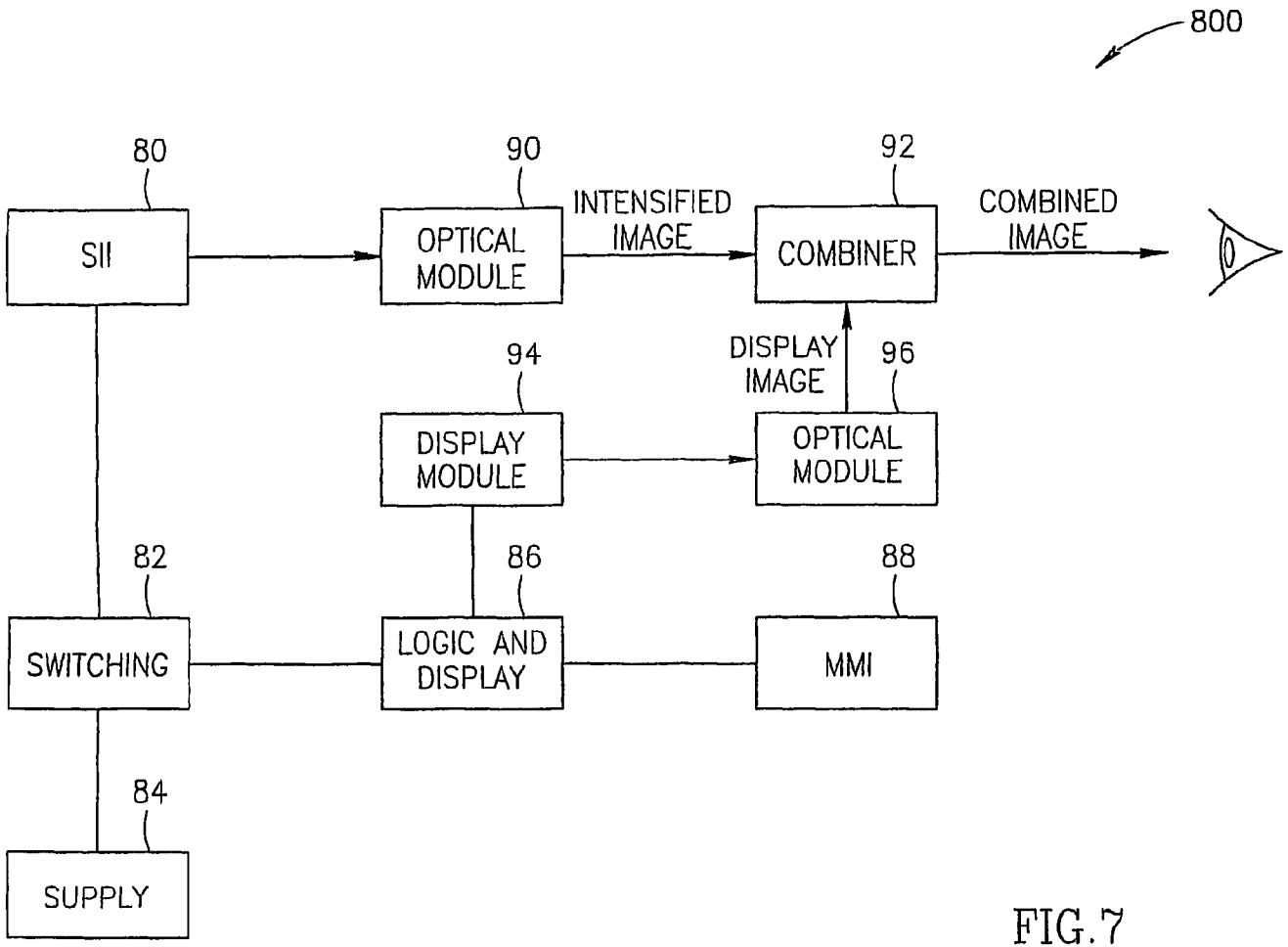
FIG. 7 is a schematic illustration of an observation system that enables the application of FIGS. 6A-6D according to some embodiments of the present invention.

Unlike existing liquid crystal shutter systems, some embodiments of the present invention allow display layers and blocking segments to be switched on/off operationally without large light power losses. An Example of such a system according to some embodiments of the present invention is shown in FIG. 7. A system 800 may comprise a segmented image intensifier 80, which may be, for example, image intensifier 10 of FIG. 1. The window gate capability of image intensifier 80 may be driven by a driver switching 82 and driver supply 84. Drivers 82 and 84 may be controlled by a logic and display driver 86, which may be coupled to a man-machine interface 88.

The intensified image of segmental image intensifier 80 may be projected by an optical module 90 to the eye of an operator via a combiner 92. A display module 94 may be controlled and driven by logic and display driver 86 and may generate a display image, which may be projected via an optical module 96 onto combiner 92. Combiner 92 may combine the intensified image provided by image intensifier 80 with the display image provided by display module 94 to output a combined image having the display image planted in the segmental window region. It should be understood to a person skilled in the art that the above-described system is exemplary only and for example system 80 may comprise additionally a camera.

EXAMPLE II

Figure 8A:
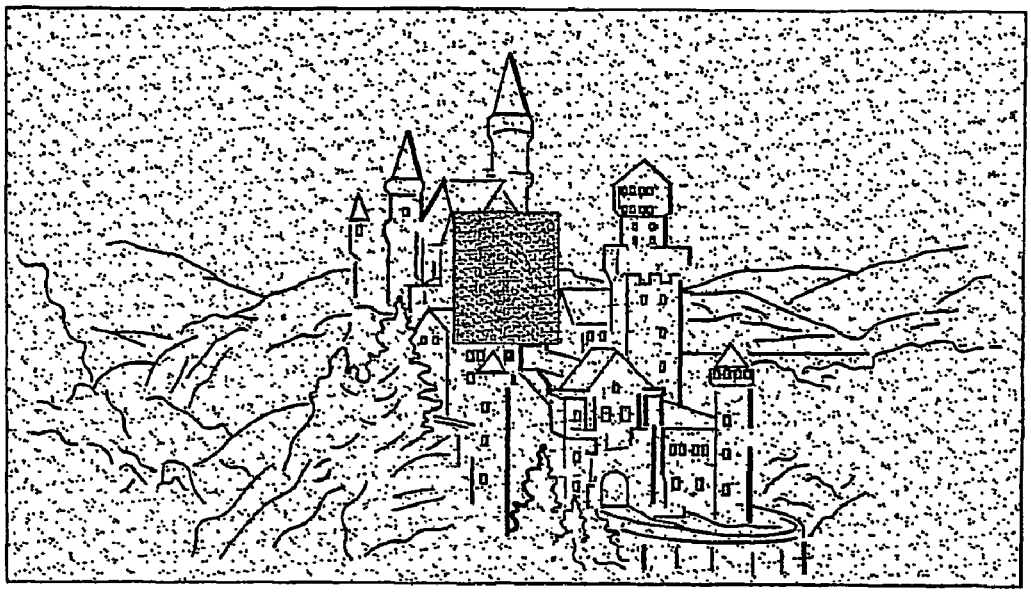
FIGS. 8A and 8B are images that illustrate improving the visibility of a dark region in a scene according to some embodiments of the present invention.
Figure 8B:
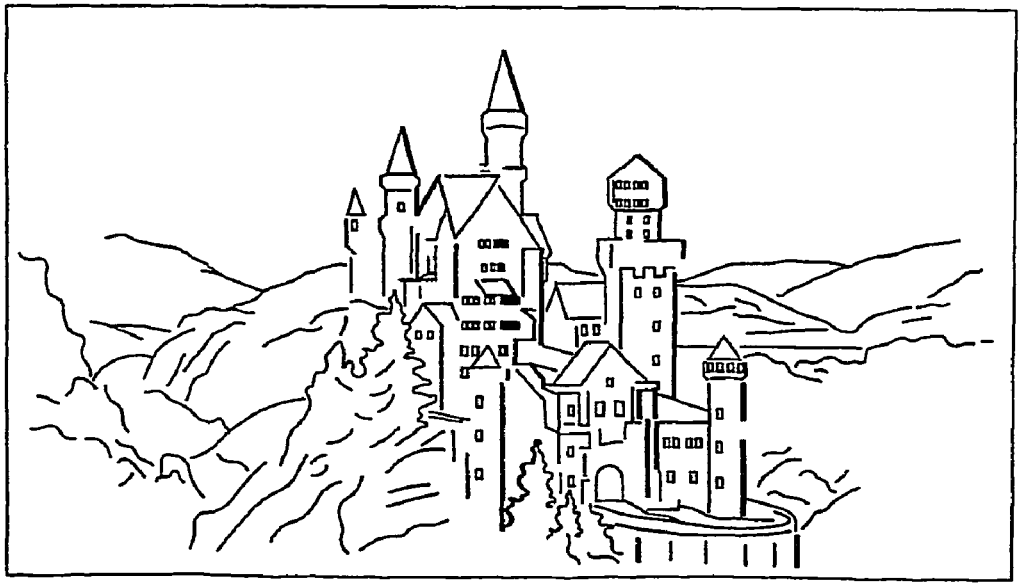

Segmental Image Amplification—Controlling the Amplification of Light Continuously Another application according to some embodiments of the present invention may be improving the visibility of a dark region in a scene. An example is an image with a portion, which is significantly darker than other portions of the image. Reference is now made to FIGS. 8A and 8*b*, which images that illustrate improving the visibility of a dark region in a scene according to some embodiments of the present invention. For this application a system similar to system 50 of FIG. 3 may be used. The image intensifier may comprise, for example, a bi-axial arrangement of electrode segments according to some embodiments of the present invention. In these embodiments, the light amplification of each segment may be monitored independently as described hereinabove. By partially subduing the lit portion of the image, namely, applying lower gain to the brighter segments using, for example, the system described with respect to FIG. 3, the automatic gain control of the system may amplify the average illumination of the scene to bring illumination of the darker region into the working region of the system. The gain applied to the segments may have a value within a continuous range of values.

Using this method may both increase and/or decrease the gain of specific segments, as required. This method may be particularly useful to increase significantly the effective dynamic range of the image intensifier.

EXAMPLE III

Segmental Image Filtering

Figure 9B:
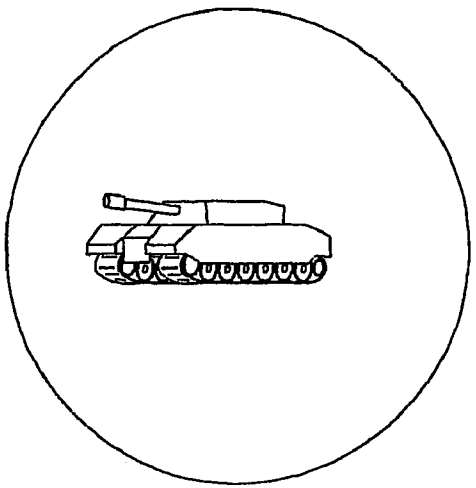
FIG.9B PRIOR ART
FIGS. 9A-9D illustrate a multi-range scene as viewed by a gated image intensifier according to some embodiments of the present invention.
Figure 9A:
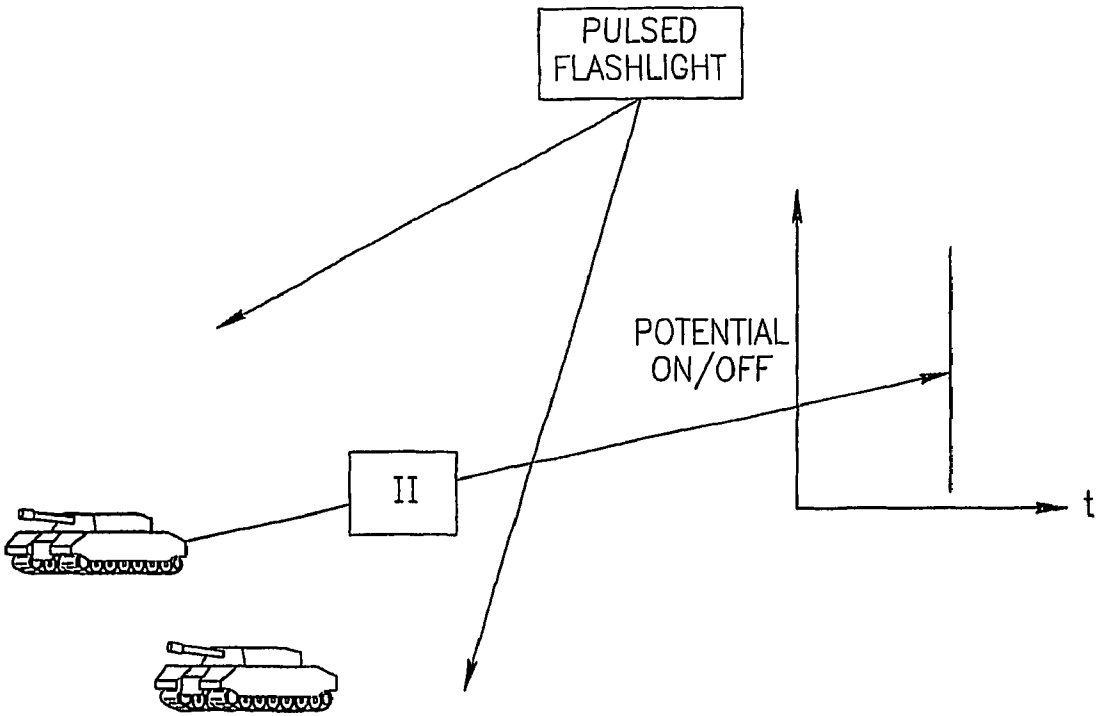
FIG.9A PRIOR ART
Figure 9D:
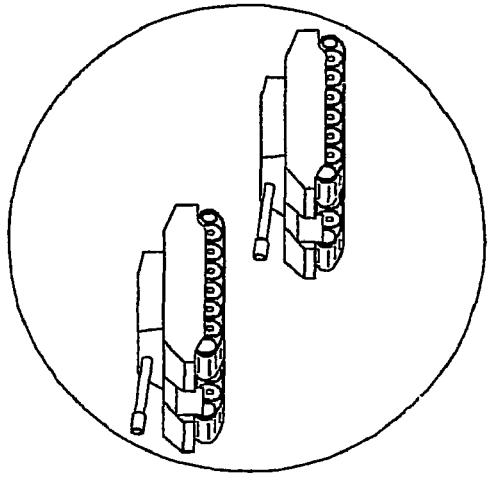
Figure 9C:
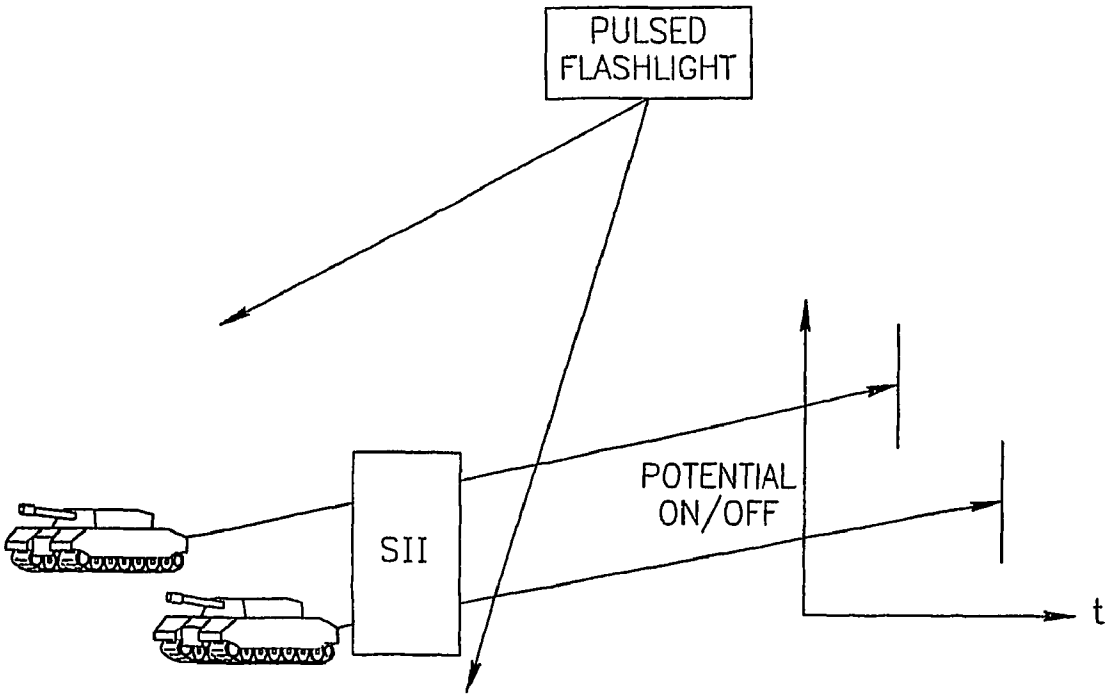

A further application, illustrated in FIGS. 9A-9D, involves displaying a full scene in a gated vision although various parts of the scene are at different distances. This is known as segmental image filtering and may be accomplished with a range finder selector. For this application, the light amplification timing of each segment may be monitored independently (FIG. 9C) to get a full image of a scene having portions of different ranges (FIG. 9D).

Many terrestrial long-range surveillance systems as well as underwater surveillance systems use gated image intensifiers combined with synchronized gated infra-red flashlights. The sampling gate of the image intensifier is opened at a specific time, thereby enabling only the light reflected from target at the selected range to be amplified and viewed. When using a vision system having a segmental image intensifier according to some embodiments of the present invention, different targets at different ranges may be viewed simultaneously and/or independently enabling real-time multi-range filtering as can be seen in FIG. 9D.

Figure 10:
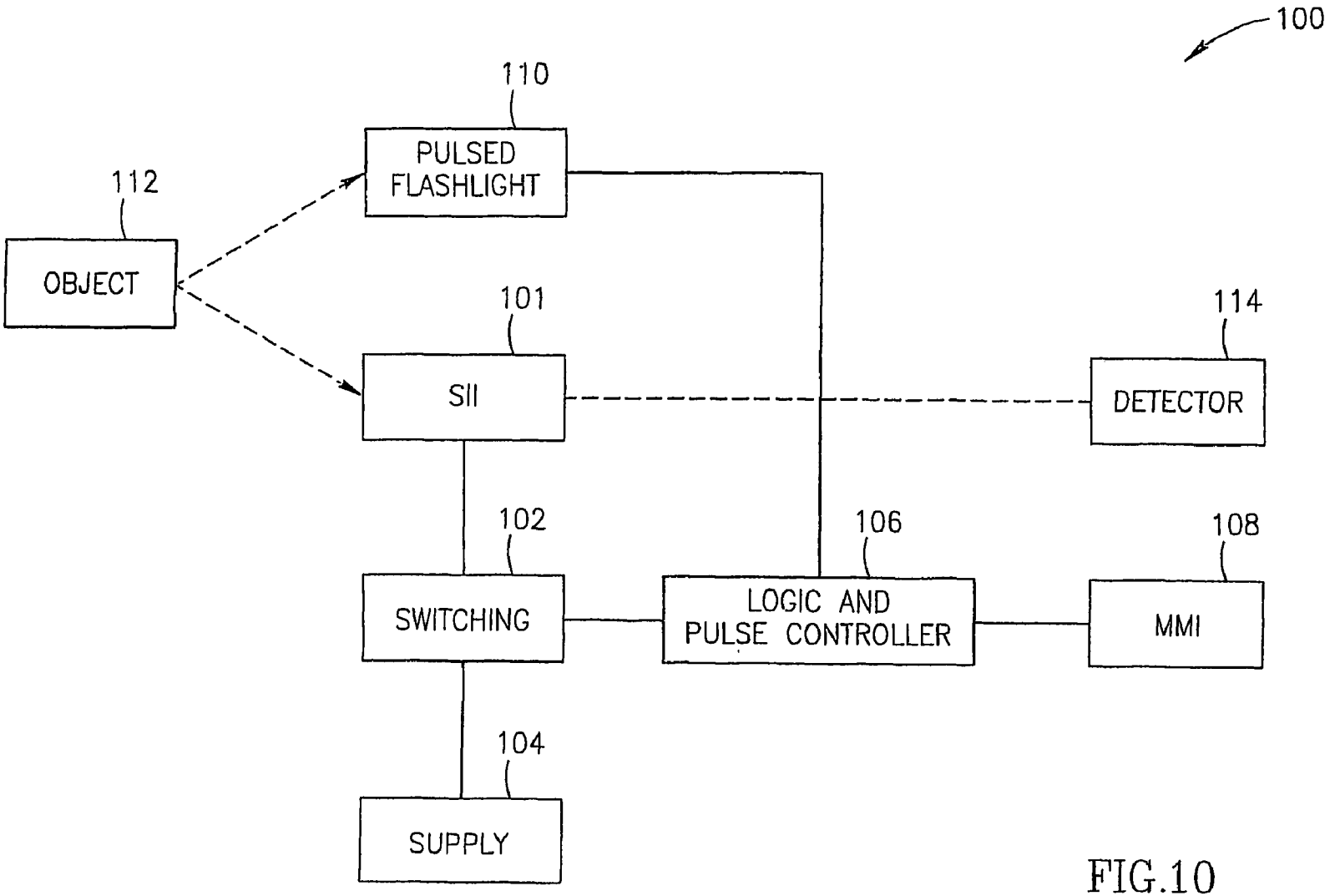
FIG. 10 is a schematic illustration of an observation system that enables the application illustrated in FIGS. 9C-9D according to some embodiments of the present invention.

An Example of such a system according to some embodiments of the present invention, is shown in FIG. 10. An observation system 100 may comprise a segmented image intensifier 101, which may be, for example, image intensifier 10 of FIG. 1 or image intensifier 50 of FIG. 3. The window gate capability of image intensifier 101 may be driven by a driver switching 102 and driver supply 104. Drivers 102 and 104 may be controlled by a logic and pulse controller 106, which may be coupled to a man-machine interface 108.

System 100 may further comprise a pulsed flashlight 110 coupled to logic and pulse controller 106. During operation, a pulsed illumination beam in the general direction of the field of view of the image intensifier 101 may be generated by pulsed flashlight 110, which is triggered by logic and pulse controller 106. The light may be reflected back by an object 112 and may be projected onto image intensifier 101. Substantially, in synchronization, logic and pulse controller 106 may instruct driver switching 102 to apply suitable independent potentials to segments of the image intensifier 101 such that a desirable segmental gate is opened to let the incoming light pass through and amplified. As this process is being repeated in a high frequency rate, a detector 114, which may be a camera or an eye of an operator, may accumulate the intensified image coming out of image intensifier 101. Logic and pulse controller 106 may instruct driver-switching 102 to activate a particular segment or segments at a particular timing and duration.

Man-machine interface 108 may enable an operator to tune system 100 in order to provide a greater dynamic range. An automatic or manual feedback mechanism may be added to system 100 similar to the controlling modes described herein above so as to ease its operation. Optionally, system 100 may comprise a line of sight measuring system (not shown) to enable farther control during motion of the observation system 100.

System 100 may further comprise a feedback-tracking mechanism, which may track the target position in three dimensions. Azimuth and elevation target tracking may be achieved by an image processing tracker module. Several approaches may be used to track targets in the depth axis, such as an image approach, which involves image analysis combined with a scanning mechanism.

Figure 11:
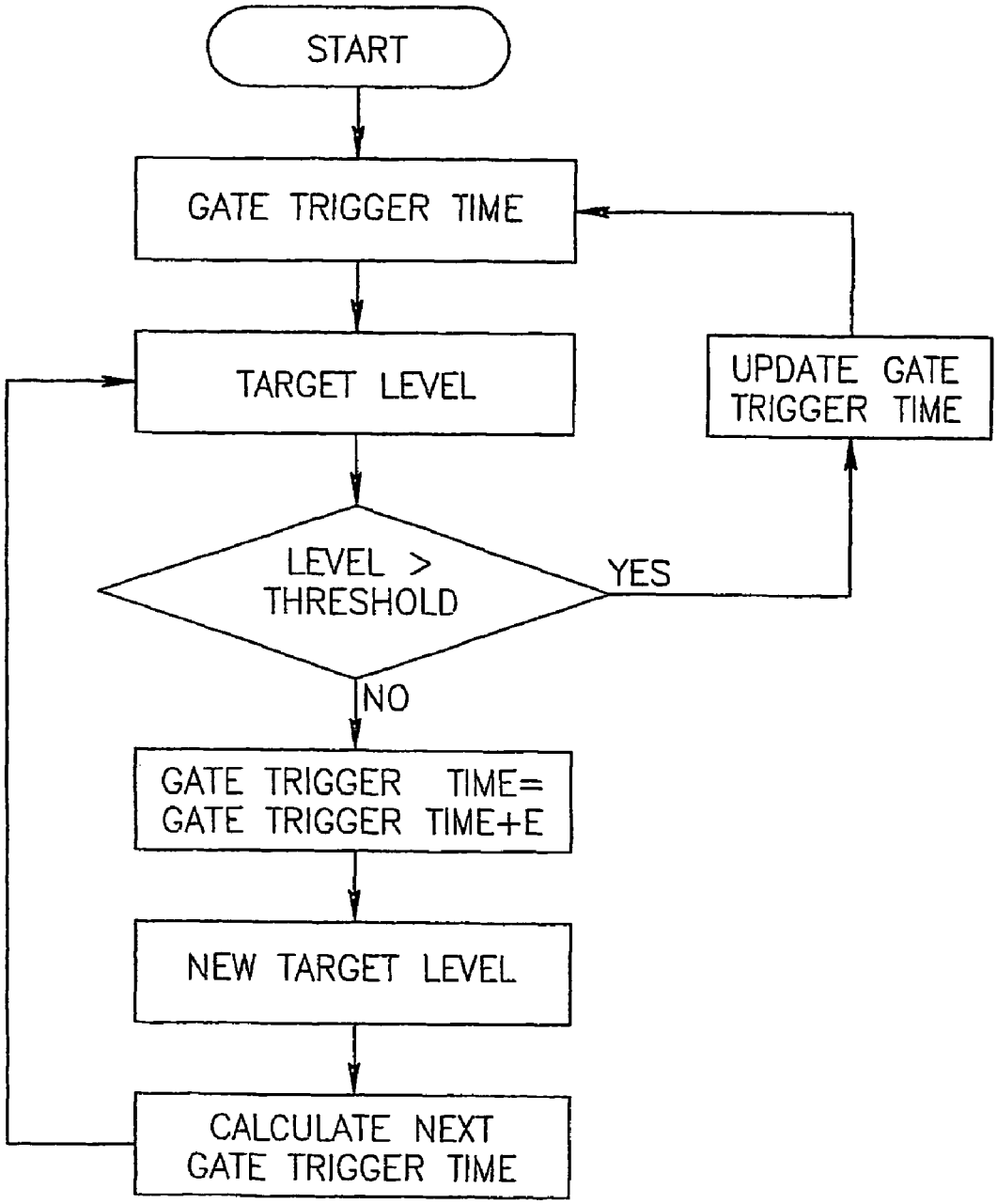
FIG. 11 is a flow chart illustration of a method for depth tracking using the image approach according to some embodiments of the present invention.

FIG. 11 is a flow chart illustration of a method for depth tracking using the image approach according to some embodiments of the present invention. The scanning mechanism may apply small changes to the gating timing around the last known gate position, thus giving a local derivative to the image with respect to the depth position. The local derivative may then be used to evaluate the best-fit gating time in order to increase signal to noise ratio (SNR).

Figure 12:
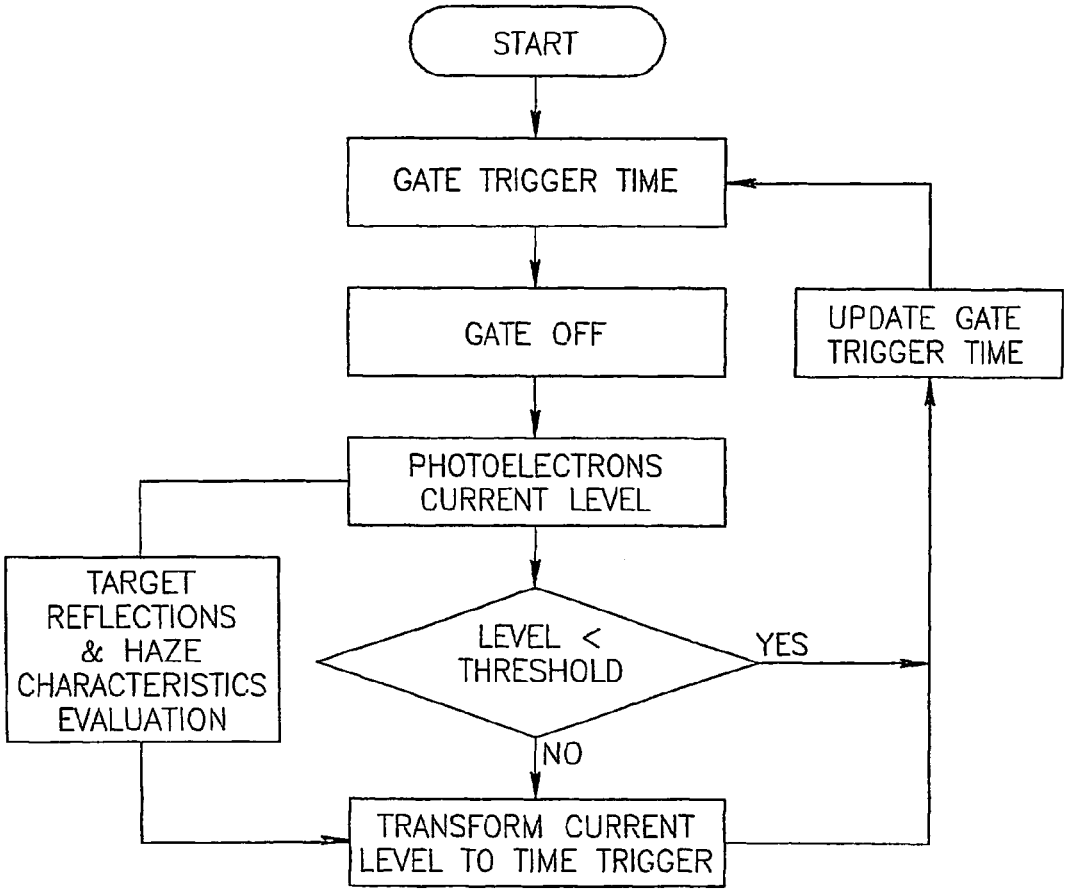
FIG. 12 is a flow chart illustration of a method for depth tracking using the photon approach according to some embodiments of the present invention.

Alternatively, a photon approach, which involves a photocurrent measurement for each segment may be applied for the feedback-tracking mechanism. FIG. 12 is a flow chart illustration of a method for depth tracking using the photon approach according to some embodiments of the present invention.

For this approach, image intensifier 101, which may be, for example, image intensifier 50 of FIG. 3. The current is measured for each segment when the segment is shut down in the "gate-off" duration. In the "gate-off duration", incoming photons may impact the photocathode 56 and may convert into photoelectrons. The photoelectrons are absorbed, in the gate-off duration, by electrode segments 58 of the absorbing electrode layer and may be sensed for the current level.

The level of the current provides information regarding the correlation between the target light echo pulse time (target distance) and the shutter gate pulse time of the image intensifier. When there is a perfect match between the two pulses, the sensing current is low and if not it increases accordingly. The switching unit 28 acting also as a sensing unit may then sample the sensing current. The samples may then be transferred to the controller 32 acting as a detection and analysis unit. The current level of the electrode segments may be analyzed to evaluate the gating time correction required to achieve a better match between the target and the gating pulses. The corrected gating pulses may be then provided to the switching unit 28 to be sent back to the electrode segments 58.

EXAMPLE IV

Luning Effect

Image intensified goggles having only partially overlapping field of view of the two channels may suffer from the luning effect. The luning effect relates to a perceptual effect, which is a subjective darkening in the monocular regions of the field of view. The luning effect occurs due to the partial overlap in the field of view, which yields a rapid change in the scene brightness level between the overlapping region versus the borders of the region, when viewed by each eye.

Figure 13A:
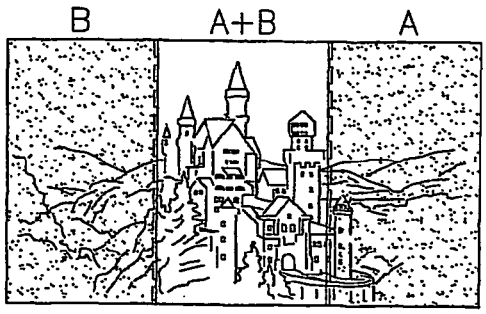
FIGS. 13A-13D illustrate a method to reduce the luning effect when using a binocular device having two image intensifiers according to some embodiments of the present invention.
Figure 13B:
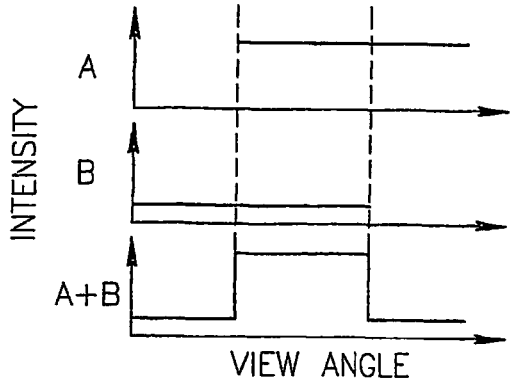

The luning effect is demonstrated in FIG. 13A. The field of view has areas A and B, corresponding to intensified images of existing image intensifiers and a central brighter area A+B, corresponding to the overlapping field of view of the image intensifier. FIG. 13B shows the intensity of light relative to the view angle for the three areas. According to some embodiments of the present invention, when using segmental image intensifiers, such as image intensifier 50 the luning effect may be reduced or even eliminated. In these embodiments, controlled light amplification may be applied to the image intensifier.

The image intensifier may comprise specially shaped electrode segments or alternatively a bi-axial array of small electrode segments creating a large area mask shape. For each image intensifier according to some embodiments of the present invention, the gain (light amplification) across the image scene may be varied gradually to provide mutual compensation between the two intensified images to eliminate the lunning effect by "softening" the sharp illumination edges at the edge of the field of view of each eye.

Figure 13C:
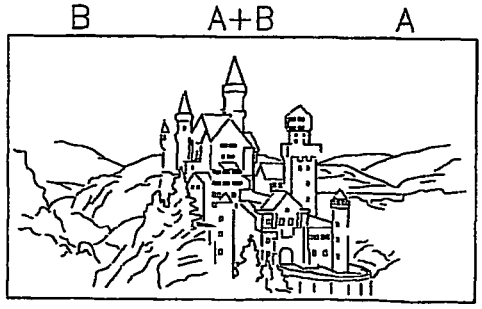
Figure 13D:
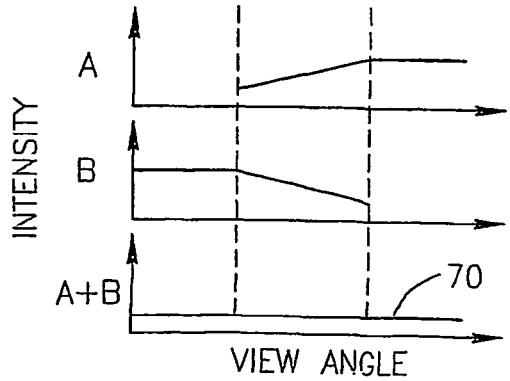

FIG. 13C shows the same scene as viewed when using a device having image intensifiers according to some embodiments of the present invention. FIG. 13D shows the intensity of light relative to the view angle for the three areas when using a device having image intensifiers according to some embodiments of the present invention. As can be seen from horizontal line 70, the intensity of light remains the same across the scene.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An image intensifier comprising:

a photocathode having a plurality of electrically isolated electrode segments thereon, said segments arranged in a matrix array with a plurality of said segments in each column and a plurality of segments in each row of the array; and a controller to simultaneously provide electrical potential independently to each of the electrode segments, thereby providing each electrode segment with a respective independent amplification gain.

2. The image intensifier of claim 1, further comprising:

an entrance window, wherein said electrode segments are coated onto an inner surface of said entrance window and each of said electrode segments is coated with a photocathode segment.

3. The image intensifier of claim 1, further comprising:

a micro channel plate, wherein said electrode segments are positioned between said photocathode and said micro channel plate.

4. The image intensifier of claim 3, wherein said electrode segments are attached to said photocathode.

5. The image intensifier of claim 3, further comprising an electrode connected to said micro channel plate to maintain a common electrical potential substantially throughout the micro channel plate.

6. The image intensifier of claim 1, wherein each of said electrode segments is coupled to a memory structure.

7. The image intensifier of claim 6, wherein said memory structure comprises a thin film transistor and a charge capacitor coupled to said thin film transistor.

8. The image intensifier of claim 1, wherein each of said electrode segments is coupled to a switching unit via an independent electrically conductive lead.

9. The image intensifier of claim 1, wherein each of said electrode segments is electrically isolated from at least one adjacent segment in any two orthogonal directions.

10. The image intensifier of claim 1, further comprising a common electrode on a microchannel plate for each of said plurality of electrode segments associated with said photocathode.

11. A system comprising:

an image intensifier including a photocathode having a plurality of electrically isolated electrode segments thereon, said segments arranged in a matrix array with a plurality of said segments in each column and a plurality of segments in each row of the array; and a controller to simultaneously generate instructions to provide electrical potential independently to each of said segments, wherein each of said electrode segments is able to detect a current in said segment and to provide data related to said current to said controller.

12. The system of claim 11, wherein said image intensifier further comprises an entrance window, and said electrode segments are coated onto an inner surface of said entrance window and each of said electrode segments is coated with a photocathode segment.

13. The system of claim 11, wherein said image intensifier further comprises a micro channel plate, and wherein said electrode segments are positioned between said photocathode layer and said micro channel plate.

14. The image intensifier of claim 13, further comprising an electrode connected to said micro channel plate to maintain a common electrical potential substantially throughout the micro channel plate.

15. The image intensifier of claim 11, wherein each of said electrode segments is electrically isolated from at least one adjacent segment in any two orthogonal directions.

16. The image intensifier of claim 11, further comprising a common electrode on a microchannel plate for each of said plurality of electrode segments associated with said photocathode.

17. The system of claim 11, wherein said controller is further able to generate new instructions to said electrodes.

18. A system comprising:

an image intensifier including a photocathode having a plurality of electrically isolated electrode segments on a photocathode said segments arranged in a matrix array with a plurality of said segments in each column and a plurality of segments in each row of the array;

a video camera to sense an intensified image produced by said image intensifier; and a controller coupled to said image intensifier and to said video camera, said controller able to simultaneously generate instructions to provide electrical potential independently to each of said segments based on said intensified image, thereby providing each electrode segment with a respective independent amplification gain.

19. The system of claim 18, wherein said image intensifier further comprises an entrance window, and said electrode segments are coated onto an inner surface of said entrance window and each of said electrode segments is coated with a photocathode segment.

20. The system of claim 18, wherein said image intensifier further comprises a photocathode layer and a micro channel plate, and said electrode segments are positioned between said photocathode layer and said micro channel plate.

21. The image intensifier of claim 20, further comprising an electrode connected to said micro channel plate to maintain a common electrical potential substantially throughout the micro channel plate.

22. The image intensifier of claim 18, wherein each of said electrode segments is electrically isolated from at least one adjacent segment in any two orthogonal directions.

23. The image intensifier of claim 18, further comprising a common electrode on a microchannel plate for each of said plurality of electrode segments associated wit said photocathode.

24. A method comprising:

individually intensifying any one or a combination of segments among a plurality of electrically isolated segments of an image, said segments arranged in a matrix array with a plurality of said segments in each column and a plurality of segments in each row of the array, by simultaneously applying independent electrical potentials to each of said plurality of segments of an image intensifier receiving said image, wherein each of said electrode segments corresponds to a segment of said image.

25. The method of claim 24, wherein each intensified image segment is intensified by an independent gain related to each of said independent electrical potentials, respectively, and wherein said gain has a value within a continuous range of values.

26. The method of claim 25, further comprising:

identifying intensified image segments whose intensity exceeds a defined illumination level; and reducing said gain for said identified intensified image segments.

27. The method of claim 25, further comprising:

identifying intensified image segments whose intensity is below a defined illumination level; and increasing said gain for said identified intensified image segments.

28. The method of claim 24, further comprising:

determining said electrical potentials at least according to current in said segments.

29. The method of claim 24, further comprising:

determining said electrical potentials at least according to the intensity of said intensified segments of said image.

30. The method of claim 24, further comprising:

determining the electrical potential of one or more of said electrode segments so that an intensified image produced by said image intensifier comprises one or more blank segments corresponding to said one or more electrode segments.

31. The method of claim 30, further comprising:

optically planting another image into said one or more blank segments of said intensified image.

32. The method of claim 24, further comprising:

determining the electrical potential or one or more of said electrode segments so that one or more image segments of an intensified image produced by said image intensifier corresponding to said one or more electrode segments is less intensified than image segments adjacent thereto.

33. The method of claim 32, further comprising:

superimposing another image onto said less-intensified image segment.

34. The method of claim 24, wherein selectively intensifying said segments comprises manually selecting said independent electrical potentials.

35. A method comprising:

receiving an image having a first portion which contains a first object at a first distance from an image intensifier and a second portion which contains a second object at a second distance from said image intensifier, said image intensifier comprising a plurality of electrically isolated segments arranged in a matrix array with a plurality of said segments in each column and a plurality of segments in each row of the array;

simultaneously applying independent electrical potentials to any combination of said electrode segments of said image intensifier that correspond to said first portion of said image at a first gating time thereby to generate a first intensified portion;

simultaneously applying independent electrical potentials to any combination of said electrode segments of said image intensifier that correspond to said second portion of said image at a second gating time thereby to generate a second intensified portion; and generating a composite image from said second and first intensified image portions.

36. A method comprising:

simultaneously applying independent electrical potentials to substantially all of a plurality of electrically isolated electrode segments of a first image intensifier of a binocular device, said segments arranged in a matrix array with a plurality of said segments in each column and a plurality of segments in each row of the array, said binocular device having an overlapping portion in its field of view; and simultaneously applying independent electrical potentials to substantially all of a plurality of electrically isolated electrode segments of a second image intensifier of said binocular device.

37. The method of claim 36, wherein said electrical potentials are applied so that segments of said output of said first image intensifier are intensified by a gain that varies gradually, and so that segments of said output of said second image intensifier are intensified by a complementary gain that varies gradually.

* * * * *